US010434809B2

(12) United States Patent
Koo et al.

(10) Patent No.: US 10,434,809 B2
(45) Date of Patent: Oct. 8, 2019

(54) BLANKET MANUFACTURING APPARATUS AND BLANKET MANUFACTURING METHOD

(71) Applicant: LG CHEM, LTD., Seoul (KR)

(72) Inventors: Beom Mo Koo, Daejeon (KR); Seung Heon Lee, Daejeon (KR); Ji Young Hwang, Daejeon (KR); Yong Goo Son, Daejeon (KR); Jooyeon Kim, Daejeon (KR); Jeseob Park, Daejeon (KR); Kun Seok Lee, Daejeon (KR)

(73) Assignee: LG CHEM, LTD., Seoul (KR)

( * ) Notice: Subject to any disclaimer, the term of this patent is extended or adjusted under 35 U.S.C. 154(b) by 196 days.

(21) Appl. No.: 14/913,598

(22) PCT Filed: Oct. 16, 2014

(86) PCT No.: PCT/KR2014/009710
§ 371 (c)(1),
(2) Date: Feb. 22, 2016

(87) PCT Pub. No.: WO2015/056983
PCT Pub. Date: Apr. 23, 2015

(65) Prior Publication Data

US 2016/0200130 A1 Jul. 14, 2016

(30) Foreign Application Priority Data

Oct. 16, 2013 (KR) ..... 10-2013-0123339

(51) Int. Cl.
*B05C 11/04* (2006.01)
*B05C 11/02* (2006.01)
*B41N 10/02* (2006.01)
*B05D 3/00* (2006.01)

(52) U.S. Cl.
CPC ..... *B41N 10/02* (2013.01); *B05C 11/023* (2013.01); *B05C 11/04* (2013.01); *B05C 11/045* (2013.01); *B05D 3/007* (2013.01); *B41N 2210/14* (2013.01)

(58) Field of Classification Search
None
See application file for complete search history.

(56) References Cited

U.S. PATENT DOCUMENTS 5,760,864 A * 6/1998 Yamada ..... G02F 1/133 349/187
2010/0139513 A1* 6/2010 Seong ..... B41F 3/10 101/252

FOREIGN PATENT DOCUMENTS

GB 1381941 A * 1/1975 ..... B41F 31/20
JP 2002-293056 A 10/2002
JP 2003136856 A * 5/2003

(Continued)

*Primary Examiner* — Binu Thomas
(74) *Attorney, Agent, or Firm* — Dentons US LLP

(57) ABSTRACT

The present specification relates to an apparatus for manufacturing a blanket. The apparatus includes a surface plate on which a substrate film is supplied; a coating unit coating a blanket composition on the substrate film; and a comma blade horizontally moving on the surface plate coated with the blanket composition. Of the whole surface of the comma blade, the surface contacting the blanket composition is an angular surface. This application also relates to a method for manufacturing a blanket, a blanket manufactured using the same, a reverse offset printing roll provided with the blanket, and a reverse offset printing apparatus including the same.

9 Claims, 3 Drawing Sheets

(56) References Cited

FOREIGN PATENT DOCUMENTS

| | | | | |
|---|---|---|---|---|
| KR | 10-2008-0090890 | A | | 10/2008 |
| KR | 10-2010-0037867 | A | | 4/2010 |
| KR | 10-2010-0038612 | A | | 4/2010 |
| KR | 1020100038612 | | * | 4/2010 |
| KR | 10-2011-0004739 | A | | 1/2011 |
| KR | 10-2011-0021367 | A | | 3/2011 |
| KR | 10-2011-0062339 | A | | 6/2011 |
| KR | 1020110062339 | | * | 6/2011 |

* cited by examiner

【Figure 1】
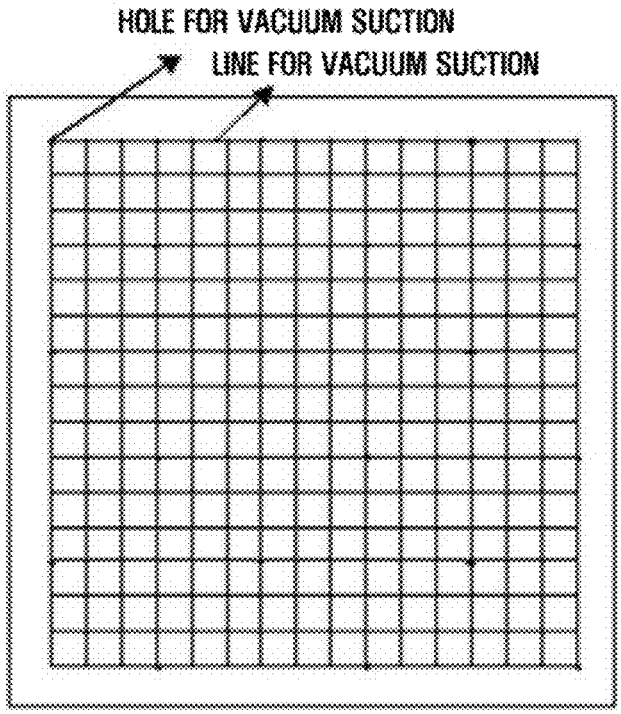
【Figure 2】
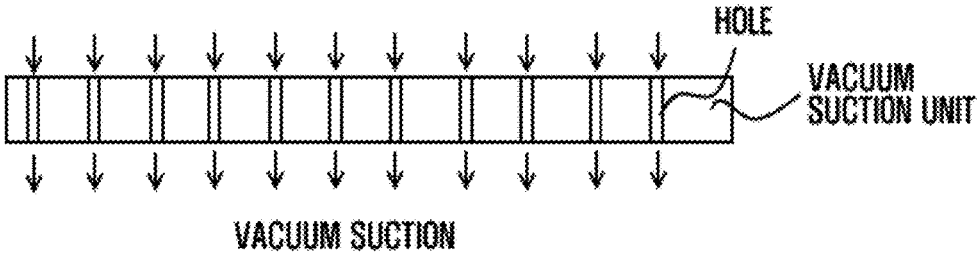

【Figure 3】
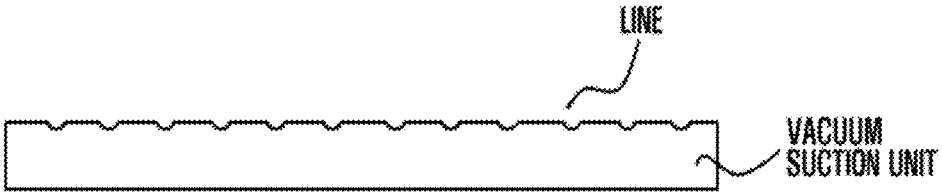
【Figure 4】
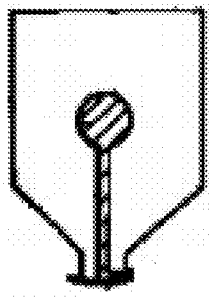
【Figure 5】
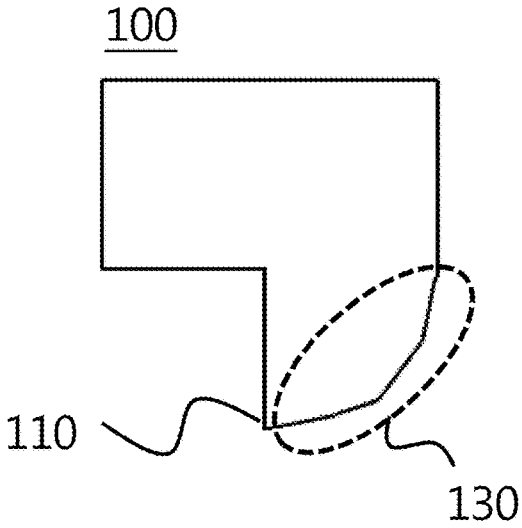

【Figure 6】
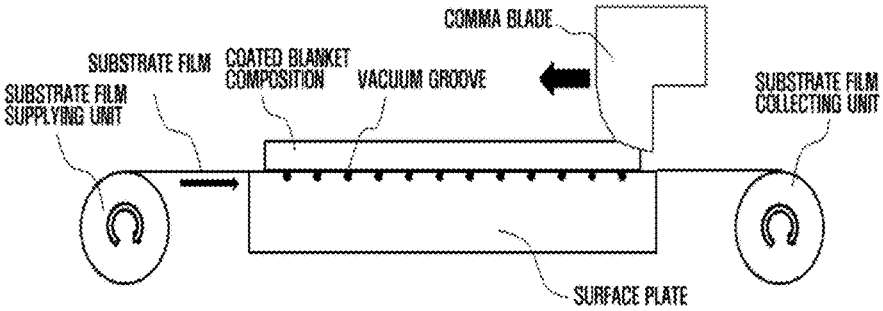
【Figure 7】
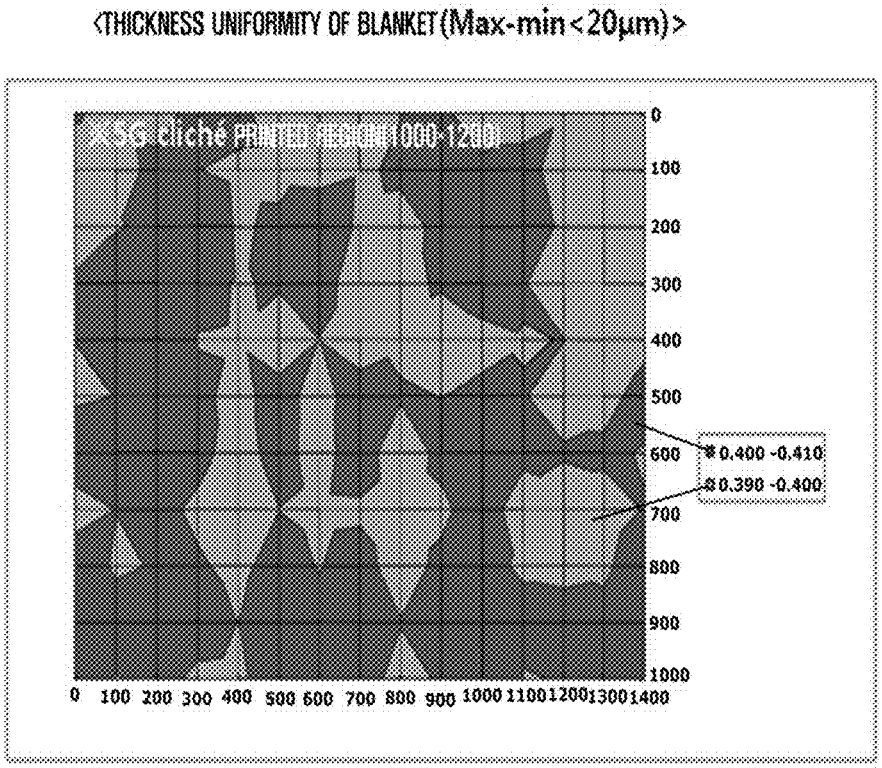

BLANKET MANUFACTURING APPARATUS AND BLANKET MANUFACTURING METHOD

This application is a National Stage Entry of International Application No. PCT/KR2014/009710, filed Oct. 16, 2014, and claims the benefit of and priority to Korean Application No. 10-2013-0123339, filed Oct. 16, 2013, both of which are incorporated herein by reference in their entirety for all purposes as if fully set forth herein.

TECHNICAL FIELD

The present specification relates to an apparatus for manufacturing a blanket, a method for manufacturing a blanket, a blanket manufactured using the same, a reverse offset printing roll provided with the blanket, and a reverse offset printing apparatus including the same.

BACKGROUND ART

Electronic devices such as liquid crystal display devices and semiconductor devices are generally manufactured by forming numerous layers of patterns on a substrate. Photolithography processes have been normally used so far in order to form such patterns. However, photolithography processes have problems in that the manufacturing process is complicated since a prescribed pattern mask needs to be prepared, and chemical etching and a stripping process need to be repeated, and chemical wastes harmful to the environment are produced in large quantities. This soon leads to an increase in the manufacturing costs and discourages product competitiveness. As a new pattern forming method for solving disadvantages of such a photolithography process, a roll printing method using a printing roll has been proposed.

A roll printing method may include various methods, but may be largely classified into a gravure printing method and a reverse offset printing method.

Gravure printing is a printing method in which an ink is coated on a blanket using a transfer roll provided with a blanket formed with patterns, and then printing is carried out after scraping off the excess ink, and is known to be suitable for printing in various fields such as publishing, packing, cellophane, vinyl and polyethylene. Researches for using the gravure printing in manufacturing active devices or circuit patterns used in display devices have been carried out. The gravure printing transfers an ink on a substrate using a transfer roll, therefore, by using a transfer roll corresponding to a target area of a display device, patterns may be formed with one transfer even in a large area display device. Such gravure printing may not only form an ink pattern, which is for resists, on a substrate, but also be used for patterning various patterns of display devices, for example, in liquid crystal display devices, a TFT and a gate line and a data line connected to the TFT as well, pixel electrodes, and metal patterns for a capacitor.

However, a blanket commonly used in gravure printing has been prepared by casting a silicone-based resin in a hard master mold, and the blanket manufactured as above not only has a limit in being manufactured to have a uniform thickness, but also has a difficulty in mass production in a pilot scale. Accordingly, a reverse offset printing method is normally employed in order to form precise micropatterns.

A reverse offset printing method is highly favored in pattern formation in terms that costs are reduced and production rates are enhanced, however, a high-quality blanket is required in order to obtain precise patterns. In other words, the manufacture of a high-quality blanket for printing is a very important technological challenge in that the quality of a pattern is influenced by the property of a blanket.

DISCLOSURE

Technical Problem

An object of the present specification is to provide an apparatus for manufacturing a blanket, a method for manufacturing a blanket, a blanket using the same, a reverse offset printing roll provided with the blanket, and a reverse offset printing apparatus including the same.

Technical Solution

The present specification provides an apparatus for manufacturing a blanket including a surface plate on which a substrate film is supplied; a coating unit coating a blanket composition on the substrate film; and a comma blade horizontally moving on the surface plate coated with the blanket composition, wherein, of the whole surface of the comma blade, the surface contacting the blanket composition is an angular surface.

In addition, the present specification provides a method for manufacturing a blanket including 1) supplying a substrate film to a surface plate; 2) coating a blanket composition on the substrate film; 3) adjusting a thickness of the coated blanket composition by horizontally moving a comma blade on the surface plate coated with the blanket composition; and 4) manufacturing a blanket by drying or curing the blanket composition at room temperature, wherein, of the whole surface of the comma blade, the surface contacting the blanket composition is an angular surface.

Furthermore, the present specification provides a blanket manufactured according to the method for manufacturing a blanket, and having a thickness variation of 20 μm or less.

In addition, the present specification provides a reverse offset printing roll provided with the blanket.

Furthermore, the present specification provides a reverse offset printing apparatus including the reverse offset printing roll.

Advantageous Effects

A blanket manufactured according to one embodiment of the present specification has an advantage of having a small thickness variation.

A large area blanket having a uniform thickness may be manufactured using an apparatus for manufacturing a blanket according to one embodiment of the present specification.

DESCRIPTION OF DRAWINGS

FIG. 1 is a front view of a surface plate provided with a vacuum suction unit having a hole structure and a line structure according to the present specification.

FIG. 2 is a side-sectional view of a surface plate provided with a vacuum suction unit having a hole structure according to the present specification.

FIG. 3 is a side-sectional view of a surface plate provided with a vacuum suction unit having a line structure according to the present specification.

FIG. 4 is a sectional view of a coater unit according to the present specification.

FIG. 5 is a sectional view of a comma blade according to one embodiment of the present specification.

FIG. 6 is a diagram showing an apparatus for manufacturing a blanket according to one embodiment of the present specification.

FIG. 7 is a graph measuring thickness uniformity of a blanket manufactured according to one embodiment of the present specification.

REFERENCE NUMERAL

100: Comma Blade
110: Edge, End Contacting with Blanket Composition
130: Surface Contacting Blanket Composition

MODE FOR DISCLOSURE

Hereinafter, the present specification will be described in detail.

The present specification provides an apparatus for manufacturing a blanket including a surface plate on which a substrate film is supplied; a coating unit coating a blanket composition on the substrate film; and a comma blade horizontally moving on the surface plate coated with the blanket composition.

In the present specification, the substrate film is not particularly limited in the material and the thickness as long as it is capable of being supplied to the surface plate and coated with the blanket composition.

In the present specification, the thickness of the substrate film may be greater than or equal to 100 μm and less than or equal to 350 μm. In this case, there are advantages in that deformation does not occur during transferring and tightening processes, and physical properties of the substrate film such as thickness uniformity are favorable.

In the present specification, the substrate film may be a plastic film.

In one embodiment of the present specification, the apparatus for manufacturing a blanket may further include a substrate film supplying unit; and a substrate film collecting unit.

The substrate film supplying unit and the substrate film collecting unit may provide the substrate film in an intermittent but continuous way. Herein, the intermittent but continuous way means supplying the substrate film by repeating the process of stopping the supply of the substrate film at constant time intervals and then continuously supplying the substrate film. For example, the substrate film is continuously supplied when supplied to an area coating the blanket composition on the substrate film, and the supply of the substrate film may be stopped for precise coating at moments when the blanket composition is coated, and dried or cured.

The substrate film supplying unit and the substrate film collecting unit are not particularly limited in the structures, materials, forms and the like as long as they are capable of supplying and collecting the substrate film, and those generally used in the art may be employed.

In the present specification, the surface plate refers to a block or table having a flat surface finished precisely and smoothly.

In one embodiment of the present specification, the surface plate is not particularly limited as long as it has a smooth flat surface so that precise work may be carried out, however, the thickness variation of the surface plate may be 20 μm or less. Specifically, the thickness variation of the surface plate may be 15 μm or less. In this case, there is an advantage in that the thickness variation of the blanket formed on the surface plate decreases. In addition, as the thickness variation of the surface plate becomes smaller, the thickness variation of the blanket decreases, and as a result, local printing pressure differences may decrease when the blanket is used for a reverse offset printing roll.

In the present specification, the thickness variation means a difference between a maximum value and a minimum value.

In one embodiment of the present specification, the material of the surface plate is not particularly limited, however, examples thereof may include any one or more of granite, artificial granite, diamond resins, ceramics, metals and glass.

In one embodiment of the present specification, the surface plate may be a granite surface plate including any one or more of granite, artificial granite and the like.

In one embodiment of the present specification, substrate film adhering means may be provided in the surface plate.

The substrate film adhering means may include a vacuum suction unit having any one or more of a hole structure, a groove structure and a line structure formed on the surface of the surface plate.

In one embodiment of the present specification, a vacuum suction unit having a hole structure and a line structure may be provided as shown in FIG. 1. Specifically, a vacuum suction unit may have a hole structure at the lattice-formed intersecting points, and have a line structure formed with grooves in the remaining area marked with lines.

In another embodiment of the present specification, a vacuum suction unit having a hole structure may be provided as shown in FIG. 2.

In still another embodiment of the present specification, a vacuum suction unit having a line structure may be provided as shown in FIG. 3.

In the present specification, in the case that the vacuum suction unit is provided as the substrate film adhering means, the vacuum suction unit may be provided at the edge of the upper surface of the surface plate in order to maintain the planarity of the surface plate. When the blanket is manufactured on the surface plate, the edge of the upper surface of the surface plate provided with the vacuum suction unit may correspond to a portion of the blanket to be removed.

The substrate film adhering means may be means providing tension so that the substrate film is capable of adhering to the surface plate. Specifically, the substrate film adhering means may be a nipping unit provided on the side surface part of the surface plate so as to provide tension to the substrate film.

In the present specification, the coating unit is not particularly limited as long as it is capable of coating the blanket composition on the substrate film, and those used in the art may be employed. For example, the blanket composition may be coated on the substrate film using a coater unit as shown in FIG. 4, or may be coated using a sputtering method.

In the present specification, the blanket composition is not particularly limited as long as it is a composition for manufacturing a blanket provided in a transfer roll for roll printing, or a printing roll, and those used in the art may be employed. For example, the blanket composition may include a siloxane-based resin composition.

In the present specification, the viscosity of the blanket composition may be greater than or equal to 10,000 cp and less than or equal to 1,000,000 cp. In this case, there is an advantage in that a blanket capable of being used for various purposes may be readily manufactured. Specifically, the viscosity of the blanket composition may be greater than or equal to 50,000 cp and less than or equal to 150,000 cp, and in this case, there is an advantage in that thickness uniformity is readily secured in a thick coating such as a blanket. When necessary, the viscosity of the blanket composition may be greater than or equal to 50,000 cp and less than or equal to 100,000 cp, and in this case, there is an advantage in that securing blanket thickness uniformity is further improved as defoamation becomes relatively simple.

In the present specification, the comma blade horizontally moves on the surface plate coated with the blanket composition. Herein, the thickness of the blanket composition is adjusted to be uniform while horizontally moving the comma blade on the surface of the blanket composition coated on the surface plate. Herein, horizontal moving means moving in parallel with the upper surface of the surface plate.

In the present invention, the comma blade refers to a blade having a "comma" shape cross section.

When the comma blade horizontally moves while being in contact with the blanket composition, a part of the blanket composition is removed by the comma blade in order to adjust the thickness of the blanket composition to be uniform. Herein, the thickness of the blanket composition is adjusted to a distance between the upper surface of the surface plate and the end (110) of the comma blade closest from the surface plate. The blanket composition removed by the comma blade in order to adjust the thickness of the blanket brings in contact with a surface (130) of the comma blade represented by a dotted line in FIG. 5.

In the present specification, the viscosity of the blanket composition coated on the substrate film is high, therefore, it is difficult to adjust the thickness of the blanket composition to be uniform using plate-type means such as a knife, a doctor blade and a squeeze. Specifically, when the viscosity of the blanket composition is high, the resistance of the contacted blanket composition is large, therefore, horizontal movement of plate-type means such as a knife, a doctor blade and a squeeze is not simple, and the plate-type means may bend due to the resistance. As a result, the thickness and the surface of the highly viscous blanket composition may not be uniformly adjusted using the plate-type means.

In the present specification, the thickness of the coated blanket composition may be greater than or equal to 0.1 mm and less than or equal to 100 mm. As the coating thickness is smaller, there is an advantage in adjusting the thickness of the composition to be uniform. Specifically, the thickness of the coated blanket composition may be greater than or equal to 0.1 mm and less than or equal to 10 mm, and as necessary, may be greater than or equal to 0.4 mm and less than or equal to 2 mm.

In the present specification, the distance between the upper surface of the surface plate and the end (110) of the comma blade closest from the surface plate may be greater than or equal to 200 μm and less than or equal to 5 mm, and specifically, may be greater than or equal to 200 μm and less than or equal to 2 mm.

In another embodiment of the present specification, the surface of the comma blade may have the surface contacting the blanket composition as an angular surface. In this case, manufacturing costs necessary to manufacture the surface contacting the blanket composition as a curved surface is saved, therefore, there is an advantage in terms of cutting of the comma blade surface.

As shown in FIG. 5, of the whole surface of the comma blade (100) of the present specification, the surface contacting the blanket composition (130) may be an angular surface.

In the angular surface of the comma blade, the acute angle formed between any one surface and a neighboring surface of the above-mentioned any one surface is greater than or equal to 5° and less than or equal to 30°.

The design dimension of the comma blade may be greater than or equal to 30 R and less than or equal to 120 R. In this case, there is an advantage in that the comma blade may have a suitable weight and size with respect to the movement of the blade for coating when designing and manufacturing the equipment. R, the unit of the design dimension, means a radius (mm), and is a common notation method in the art.

In one embodiment of the present specification, the apparatus for manufacturing a blanket may further include a control unit adjusting the distance from the end (110) of the comma blade to the upper surface of the surface plate.

In the present specification, the control unit may horizontally move the comma blade while adjusting the distance to the upper surface of the surface plate.

In the present specification, the control unit is not particularly limited as long as it is capable of moving the comma blade, and adjusting the distance to the upper surface of the surface plate, and those used in the art may be employed.

The present specification provides a method for manufacturing a blanket including 1) supplying a substrate film to a surface plate; 2) coating a blanket composition on the substrate film; 3) adjusting a thickness of the coated blanket composition by horizontally moving a comma blade on the surface plate coated with the blanket composition; and 4) manufacturing a blanket by drying or curing the blanket composition at room temperature.

The descriptions for the substrate film, the surface plate, the blanket composition and the comma blade in the method for manufacturing a blanket are the same as the descriptions made above.

The method for manufacturing a blanket of the present specification includes 1) supplying a substrate film to a surface plate.

In one embodiment of the present specification, in the step of 1), the substrate film may closely contact the surface plate by applying vacuum negative pressure to the substrate film through a vacuum suction unit having any one or more of a hole structure, a groove structure and a line structure formed on the surface of the surface plate.

In one embodiment of the present specification, in the step of 1), the substrate film may closely contact the surface plate using means providing tension to the substrate film.

The method for manufacturing a blanket of the present specification may further include an step of removing dust on the substrate film prior to the step of 1).

The method for manufacturing a blanket of the present specification may further include an step of supplying the substrate film on the surface plate through the substrate film supplying unit and the substrate film collecting unit prior to the step of 1).

In the present specification, after the step of 1), the substrate film may closely contact the surface plate by applying tension to the substrate film through the substrate film supplying unit and the substrate film collecting unit.

The method for manufacturing a blanket of the present specification includes 2) coating a blanket composition on the substrate film.

In the step of 2), the method of coating a blanket composition is not particularly limited, and methods used in the art may be employed. For example, the blanket composition may be coated on the substrate film through a coater unit as shown in FIG. 4, or coated using a sputtering method.

In the step of 2), blanket compositions having different compositions may be coated twice or more.

The blanket composition is not particularly limited, and those used in the art may be employed. For example, the blanket composition may include a siloxane-based resin composition.

In one embodiment of the present specification, an step of forming a primer layer on the substrate film may be further included prior to the step of 2). Specifically, the primer layer may be formed by coating a composition for a primer layer on the substrate film, and drying or curing the result.

The primer layer is not particularly limited as long as it is for enhancing adhesion strength between the substrate film and the blanket composition, and those used in the art may be employed. For example, the primer layer may be formed using a silane-based coupling agent.

The thickness of the primer layer is not particularly limited, however, for example, may be greater than 0 μm and less than 1 μm. In this case, there is an advantage in that stains and the like caused by quick drying do not occur.

The method for forming the primer layer is not particularly limited, however, for example, a spray method, a coating method using a brush or gauze may be used.

The method for manufacturing a blanket of the present specification includes 3) adjusting a thickness of the coated blanket composition by horizontally moving a comma blade on the surface plate coated with the blanket composition.

In the present specification, the step of 3) horizontally moves the comma blade so that the distance from the end (110) of the comma blade to the upper surface of the surface plate remains constant.

As shown in FIG. 6, a substrate film is supplied on a granite surface plate provided with a hole-structured vacuum suction unit, and a polydimethylsiloxane (PDMS) composition may be coated on the substrate film. The thickness of the composition may be adjusted while horizontally moving the comma blade as shown in FIG. 6 on the granite surface plate coated with the polydimethylsiloxane composition.

The method for manufacturing a blanket of the present specification includes 4) manufacturing a blanket by drying or curing the blanket composition at room temperature.

Specifically, the blanket composition of which thickness is adjusted by the comma blade may be dried or cured at room temperature while being placed on the surface plate.

In the present specification, the time for drying or curing the blanket composition at room temperature may be greater than or equal to 3 hours to less or equal to 24 hours.

In the present specification, an step of curing the blanket composition on the surface plate through heat or UV irradiation may be further included after the step of 4).

In one embodiment of the present specification, an step of forming a functional layer on the substrate film may be further included prior to the step of 2).

In one embodiment of the present specification, an step of forming a functional layer on the blanket may be further included after the step of 4).

In the present specification, the functional layer means a layer additionally formed in order to supplement the physical properties and the like of the blanket, and although not particularly limited thereto, examples thereof may include a planarization layer, a slip layer, a cushion layer and the like.

The thicknesses of the planarization layer and the slip layer are not particularly limited, however, for example, the thickness of the planarization layer may be greater than or equal to 200 μm and less than or equal to 1,000 μm when the planarization layer is provided on the blanket, and the thickness of the slip layer may be 20 μm or less when the slip layer is provided on the blanket.

An step of carrying out a defect inspection such as a foreign substance inspection of the blanket formed after the step of 4) may be further included.

An step of cutting the blanket formed after the step of 4) to a size of a roll to be installed may be further included. Herein, unnecessary portions of the blanket may be removed.

A method for continuously manufacturing a blanket while moving a substrate film and the like between rolls has a disadvantage in that fairly long initial production amount is lost in order to stabilize the thickness and check the coating property of the blanket in the initial stage.

In addition, when a blanket is continuously manufactured using a roll to roll method, there is a disadvantage in that prompt response with respect to bubbles and foreign substances on the surface is difficult, and since the movement is made using a tension adjustment apparatus and various supporting rolls, tension during the move is not proper, or uniform thickness of the blanket is difficult to be secured due to the contamination and damage of the supporting roll.

Particularly, as the area of the manufactured blanket becomes larger, influences of the disadvantages described above becomes bigger causing an increase in the manufacturing costs, and manufacturing a uniform blanket is difficult.

Meanwhile, the method for manufacturing a blanket of the present specification has an advantage in that there are no failure costs caused by discarding an initial production amount, since a blanket composition is coated on a substrate film placed on a surface plate, and the result is dried or cured on the surface plate without being moved.

The method for manufacturing a blanket of the present specification has an advantage in that prompt response with respect to bubbles and foreign substances on the surface of the blanket composition may be obtained.

The method for manufacturing a blanket of the present specification has an advantage in that the blanket is not damaged or contaminated since there are no processes of moving the blanket after coating a blanket composition on a substrate film.

The method for manufacturing a blanket of the present specification has an advantage in that a blanket having a uniform thickness may be prepared even when the area of the manufactured blanket becomes larger.

FIG. 7 shows the thickness uniformity of the blanket manufactured according to the present specification, and the area of the blanket is 1300 mm×1800 mm, and it can be seen that the difference between the highest point and the lowest point is 20 μm or less.

The present specification provides a blanket manufactured according to the method for manufacturing a blanket of the present specification and having a thickness variation of 20 μm or less. In this case, there is an advantage in that the blanket has uniform thickness due to small thickness variation. Accordingly, precise patterns may be transferred or printed using the blanket.

The blanket of the present specification is manufactured according to the method for manufacturing a blanket of the present specification, has a thickness variation of 20 μm or less, and may have a large area of 1000 mm×1000 mm or greater. Specifically, the area of the blanket may be 1300 mm×1800 mm or greater. In this case, there is an advantage in that precise patterns may be formed on large area printed articles using a blanket having a large area and a uniform thickness. When necessary, the area of the blanket may be 1400 mm×2200 mm or greater.

The present specification may be used in a roll or a flat plate that needs a blanket having a uniform thickness, and the use of the blanket is not limited.

The present specification provides a reverse offset printing roll provided with the blanket.

The present specification provides a reverse offset printing apparatus including the reverse offset printing roll.

The present specification may be used in technology fields reproducing micropatterns using the blanket.

The invention claimed is:

1. An apparatus for manufacturing a blanket comprising:

a surface plate on which a substrate film is supplied;

a coating unit coating a blanket composition on the substrate film; and a comma blade horizontally moving on the surface plate coated with the blanket composition, wherein the comma blade comprises an angular surface for contacting the blanket composition and the angular surface of the comma blade comprises a structure in which two planes forming the angular surface contact each other at an exterior angle of 5° or more and 30° or less, and wherein a distance between an upper surface of the surface plate and an end of the comma blade closest to the upper surface of the surface plate is 200 μm or more and 5 mm or less such that the distance remains constant during horizontal movement.

2. The apparatus for manufacturing a blanket of claim 1, wherein viscosity of the blanket composition is 10,000 cp or more and 1,000,000 cp or less.

3. The apparatus for manufacturing a blanket of claim 1, wherein a thickness of the coated blanket composition is 0.1 mm or more and 100 mm or less.

4. The apparatus for manufacturing a blanket of claim 1, wherein the surface plate has a thickness variation of 20 μm or less.

5. The apparatus for manufacturing a blanket of claim 1, wherein the surface plate includes any one or more of granite, artificial granite, diamond resins, ceramics, metals and glass.

6. The apparatus for manufacturing a blanket of claim 1, wherein the surface plate is provided with substrate film adhering means.

7. The apparatus for manufacturing a blanket of claim 6, wherein the substrate film adhering means includes a vacuum suction unit having any one or more of a hole structure, a groove structure and a line structure formed on the surface of the surface plate.

8. The apparatus for manufacturing a blanket of claim 1, further comprising:

a control unit adjusting a distance from an end of the comma blade closest from the surface plate to an upper surface of the surface plate.

9. The apparatus for manufacturing a blanket of claim 1, further comprising:

a substrate film supplying unit; and a substrate film collecting unit.

* * * * *